US005180326A

United States Patent [19]

Williams

[11] Patent Number: 5,180,326

[45] Date of Patent: Jan. 19, 1993

[54] REVERSIBLE MASTECTOMY BRASSIERE

[76] Inventor: Marguerite R. Williams, 443 W. 44th St., New York, N.Y. 10036

[21] Appl. No.: 821,577

[22] Filed: Jan. 26, 1992

[51] Int. Cl.[5] ..... A41C 3/00; A41C 3/02

[52] U.S. Cl. ..... 450/91; 450/23; 450/31; 450/32; 450/58; 450/79; 450/86; 2/73

[58] Field of Search ..... 2/73, 104, 105, 106, 2/114, DIG. 7, 70, 71, 72, 86, 94; 450/1, 5, 10, 12, 23, 31, 32, 36, 58, 68, 79, 80, 86, 91

[56] References Cited

U.S. PATENT DOCUMENTS

| | | | |
|---|---|---|---|
| 1,272,427 | 7/1918 | Haderlein | 450/58 |
| 1,849,514 | 5/1932 | Edelmann | 450/91 |
| 1,966,174 | 7/1934 | Jones | 450/79 X |
| 2,390,465 | 12/1945 | Russo | 450/58 |
| 2,486,836 | 11/1949 | Garson | 450/91 |
| 2,611,130 | 9/1952 | Engelman | 450/91 |
| 2,753,569 | 7/1956 | Schmalz | 450/36 |
| 2,762,052 | 9/1956 | Olson | 450/79 X |
| 2,966,785 | 1/1961 | Goff et al. | 450/91 |
| 3,311,112 | 3/1967 | Murray | 450/82 X |
| 3,378,013 | 4/1968 | Bruno | 450/68 |
| 3,507,285 | 4/1970 | Williams | 450/1 |
| 3,968,803 | 7/1976 | Hyman | 450/58 X |
| 4,269,191 | 5/1981 | Evans | 450/86 X |
| 4,294,257 | 10/1981 | Rennhofer | 2/67 |
| 4,314,569 | 2/1982 | Speno | 450/1 |
| 4,393,875 | 7/1983 | O'Boyle et al. | 450/1 |
| 4,550,734 | 11/1985 | Porco | 450/36 |
| 4,804,351 | 2/1989 | Raml et al. | 450/58 |
| 4,909,771 | 3/1990 | Bergman | 450/70 X |
| 4,957,466 | 9/1990 | Hopps | 450/23 X |
| 5,068,924 | 12/1991 | Ross | 450/86 X |
| 5,098,331 | 3/1992 | Corrado | 450/1 X |

*Primary Examiner*—Werner H. Schroeder
*Assistant Examiner*—Jeanette E. Chapman

[57] ABSTRACT

A reversible mastectomy brassiere which may be worn soon after surgery is disclosed with the primary purpose of this brassiere concept being to provide a mastectomy brassiere which may position a prosthesis on the left breast, or when said brassiere is completely reversed, to position a prosthesis on the right breast of the mastectomy patient. This design further includes front fasteners which function equally well irrespective of the side on which the brassiere is worn. The brassiere will provide adequate coverage for the patient soon after surgery, without the necessity of an expensive and time consuming special fitting. The second important aspect of this design is its continuous unbroken and smooth appearance when worn becuase the brassiere configuration and all outer edges have no apparent sewing or standard finishing of any kind on the outer surface of the brassiere. This design blends smoothly with the body's contour and gives visual reassurance and psychological relief to the patient recovering from the trauma of surgery.

10 Claims, 5 Drawing Sheets

A-A

REVERSIBLE MASTECTOMY BRASSIERE

This invention relates to a reversible mastectomy bra, and in particular to a new concept in the construction and adaptability for its use after surgery for Mastectomy, Reconstruction and/or cosmetic reasons.

The sewing construction of this bra is done so as to result in almost invisible seams when worn on either side, including the straps and front closing, which are equipped with flat and smooth adjustments.

The purpose of the bra is to provide both physical and psychological relief to the patient, who after surgery is faced with the altered appearance of her chest. Therefore a most important application of this concept is that the patient could conceivably be supplied with this bra even before surgery, and upon inserting a lightweight disposable prosthesis into the pocket have the garment ready to wear upon removal of post-operative bandages.

The front closure provides easy entry into the bra, at a time when reaching to the back to fasten any wearing apparel is both difficult and painful.

Subsequent to surgery the mastectomy patient is faced with many problems, both medical and psychological. The change in the physical appearance of the patient needs visual and uncomplicated relief as soon as possible.

This is usually resolved at a much later time, when the patient is sufficiently recovered to face the search for the proper bra, the correct prosthesis and the right fitter to supply her needs.

Typically, the standard mastectomy bra consists of varied designs with combinations of fabrics and trimmings, all aimed at disguising the purpose of the garment. It may come with one or more pockets already included or added to the bra by the fitter, all of which results in a lot of visible sewing and expense.

The aesthetic result of this novel bra design is that the wearer will appear to herself as close to a pre-surgery look as possible. The bra is flat and smooth with outer boundaries blending onto the chest, as will be described hereafter.

The concealing of any construction (sewing) of this bra achieved by having two identical components, which separately would produce a standard bra, but when joined together and turned inside-out compose one continuous unit, opening in the front and equipped with an opening for a prosthesis.

It is therefore an objective of this invention to provide a reversible mastectomy bra with:

(1) Pocket for prosthesis.

(2) Support for the remaining breast.

(3) Easy access with its simple front closure and complete concealment of its primary function while performing its needs.

Another psychological objective of this reversible bra is to provide a garment to be worn while resting, relaxing or sleeping. The presently available bras are intended for use when the woman is dressed in a daily routine manner. This bra will not be very visible under night clothes or leisure clothes because it will blend with the body in an unbroken look.

This bra, being reversible, eliminates the need for left or right pockets. Only the side of one cup needs to be open to insert the prosthesis, since the bra can be reversed to use said prosthesis on either the right or left breast.

The configuration of the space to contain the prosthesis makes this a unique design because the front cup element of the bra reaches and covers a large portion of the underarm and also reaches up toward the top of the shoulder to accomadate varied types of surgery.

Some surgeries require small rather round prostheses, others require more extensive vertical coverage, and still others a rather slanted or quasi-horizontal placement of the prosthesis to suit the post-operative anatomical need of the wearer.

The unique double-cloth construction of this novel bra design enables each cup of said bra to act as a prosthesis-receiving pocket, such pocket design being a decided advantage over bras presently in use because such standard bras have various problems to hold certain prostheses and require considerable sewing and additions to the existing standard pockets.

Another advantage of this novel bra concept is the complete flatness of the finished bra, which has no tape, protruding seams or any embellishment to detract from the bras near invisibility when worn.

For purposes of clarity in the description and accompanying illustrations of this mastectomy bra invention, the right and left cup elements of the bra consist of molded cups.

The design of the bra herewith being described, however, does not preclude the possibility that the right and left cups could each be constructed of two elements or three elements, of elastic fabric, etc., or other means of achieving a breast shape without in any way altering the basic concept or novelty of this bra design.

The preferred material of choice for the construction of this bra consists of an all-cotton cloth, in order to take advantage of its stretchability and ability to blend with the wearer's flesh by using the appropriate skin color in such an all-cotton cloth.

Obviously, however, other types of materials may be used for construction of this bra without in any way altering the basic concept of this novel mastectomy bra design.

The fasteners of choice are small hooks for the front closure and strap adjustments, in conjunction with a folded ribbon used step-ladder fashion. Such preferred materials do not preclude the alternative use of Velcro, buttons and button holes, snaps, other types of hooks, etc., well known in the art.

These and other novel features of the invention will be more readily apparent from a detailed description of the drawings thereof in which.

Figure 5:
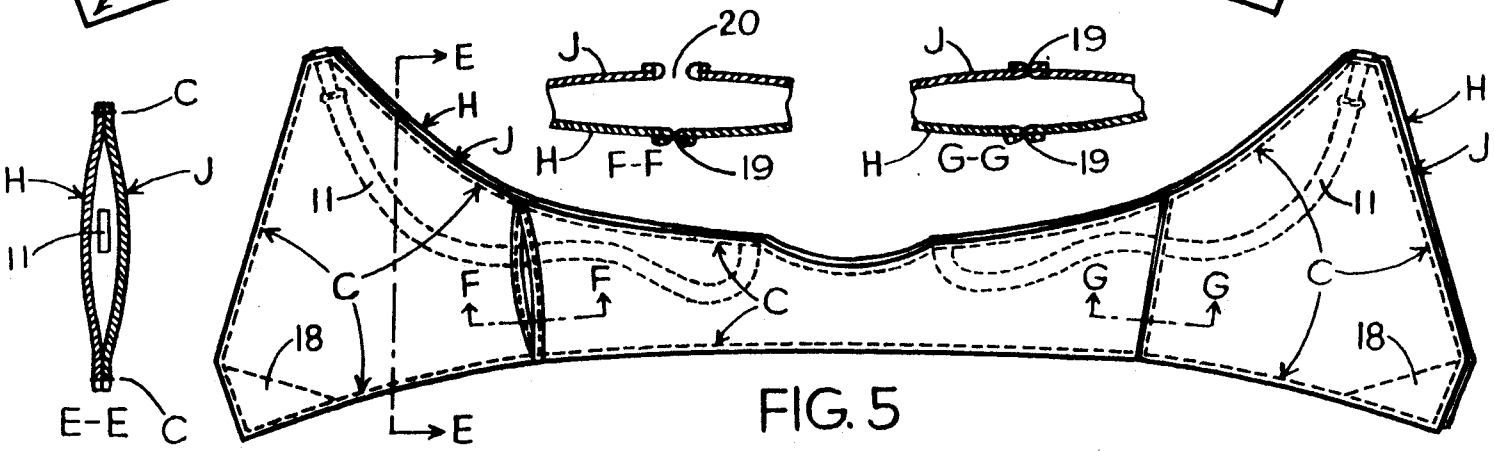
FIG. 5 shows said two separate bra units as in FIG. 4 which have been joined together and sewn around the periphery thereof.
Figure 6:
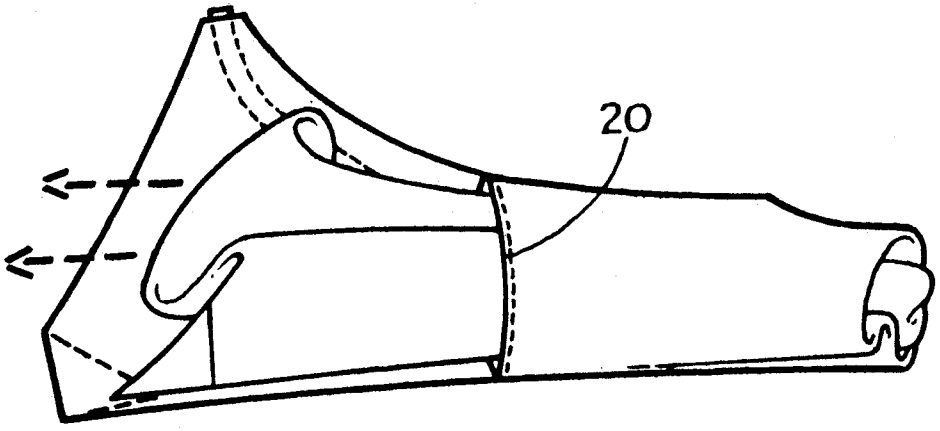

FIG. 6 indicates the method by which the completed bra of FIG. 5 is pulled inside-out through the open side seam.

Figure 7:
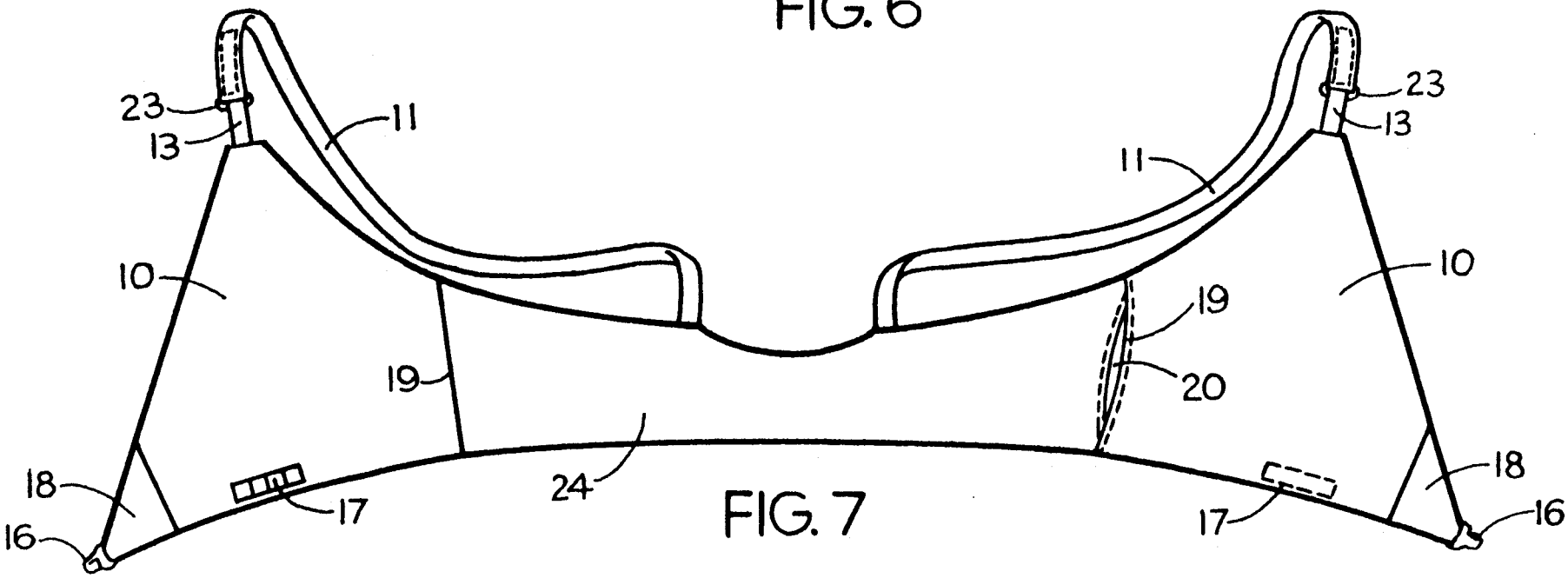

FIG. 7 is a rear elevational view of the completed bra in which no seams are visible on its periphery on either the rear view as shown or on the front view when said bra is reversed.

Figure 1:
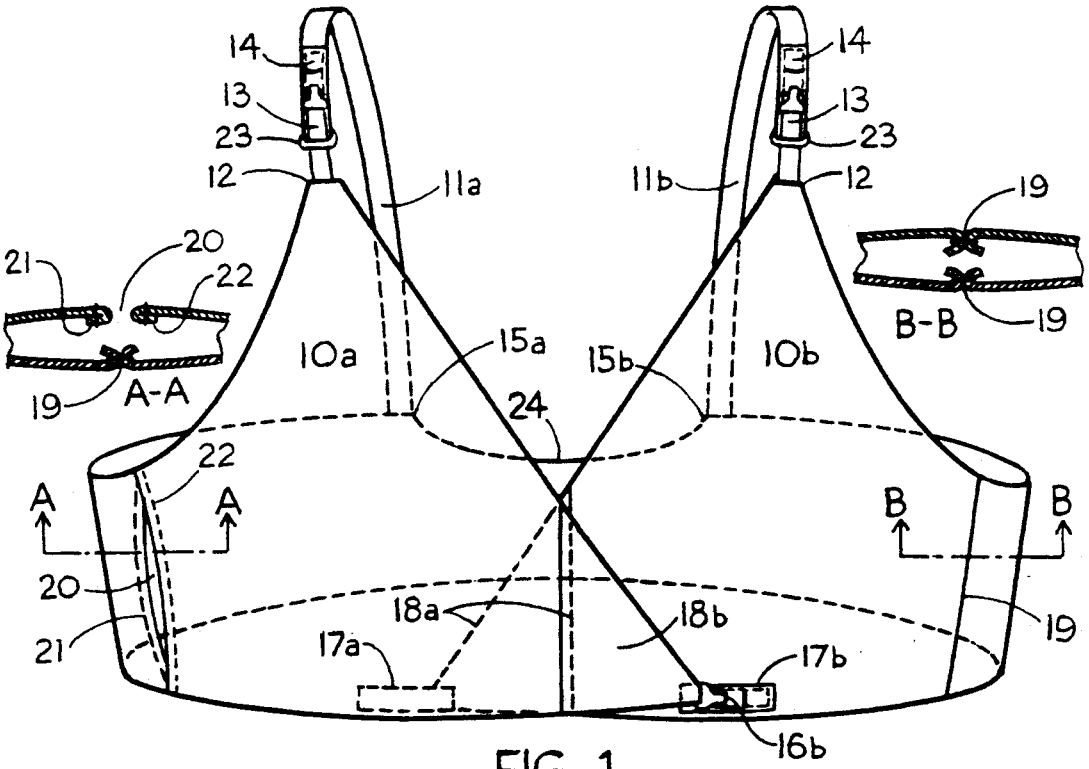
FIG. 1 is a front elevational view of a completely assembled mastectomy bra showing an opening for a prosthesis located on the outside of the right side of said bra.
Figure 2:
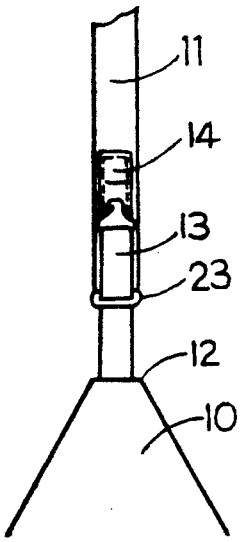
FIG. 2 is a detailed drawing of the right and left side strap adjustments as shown in FIG. 1.
Figure 8:
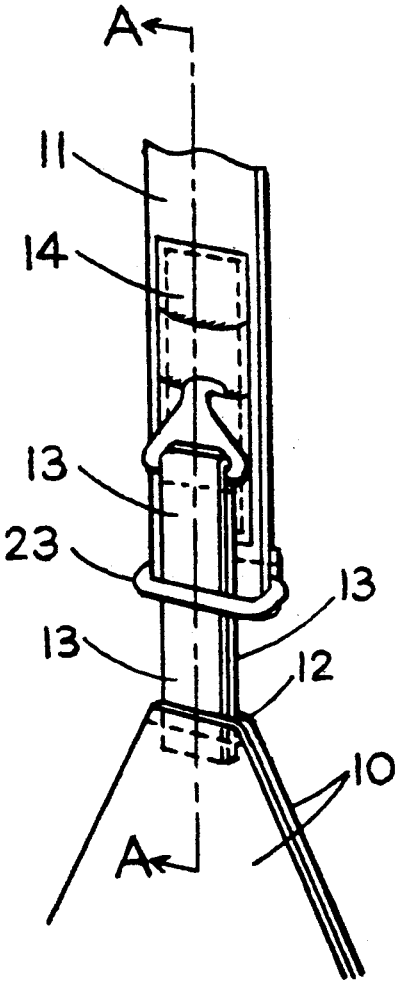

FIG. 8 is a perspective drawing of the right and left side strap adjustments as shown in FIG. 1 and FIG. 2.

Figure 9:
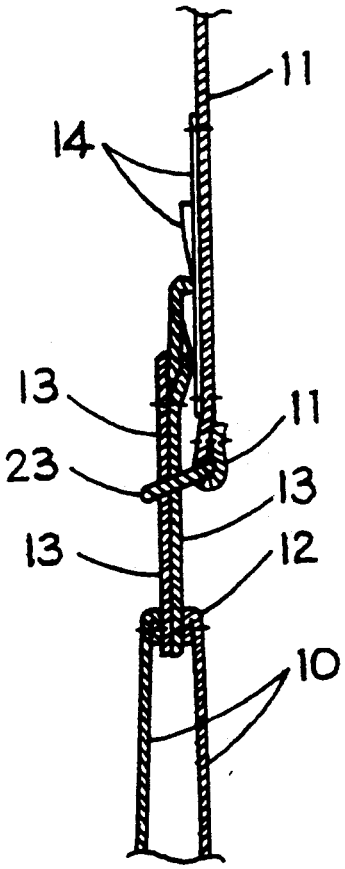

FIG. 9 is a sectional drawing of the right and left side strap adjustments as shown in FIG. 1 and FIG. 2.

While performing all the functions of a mastectomy bra, this invention is dissimilar from all other mastectomy bras in its uniquely smooth, pleasing and deceptively simple appearance, as well as its novel construction which permits reversing the position of the bra, so that an inserted prosthesis may cover either the right breast or left breast.

Figure 1A:
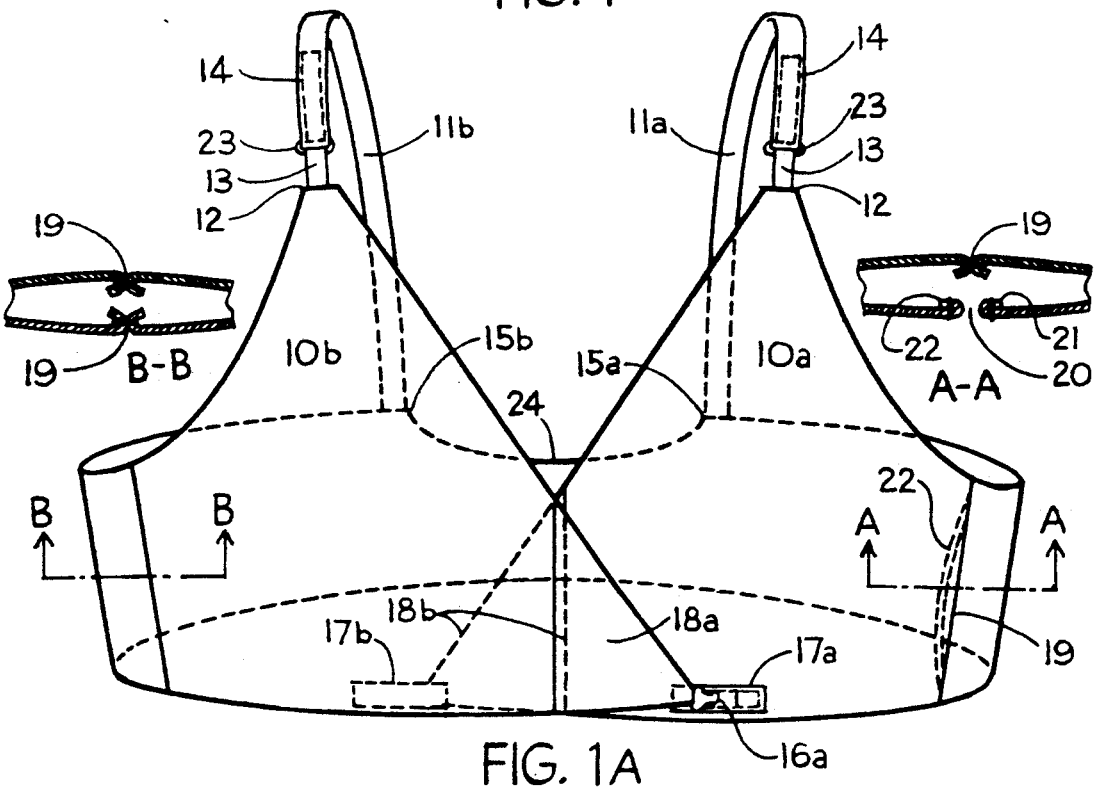
FIG. 1A is a front elevational view of the completely assembled mastectomy bra as shown in FIG. 1 which has been reversed, showing an opening for a prosthesis located on the inside of the left side.

FIGS. 1 and 1A appear essentially the same and interchangeable, which is the primary element of this invention.

FIG. 1 shows the completed bra with both side seams shown, with open side seam 20 exposed to view. When worn in this manner, an inserted prosthesis will perform as a mastectomy bra for the missing, surgically removed right breast.

FIG. 1A shows the completed bra in reversed position, in which the outside surface of the bra as shown in FIG. 1 now comprises the inside surface of the bra, and the inside surface of FIG. 1 is now seen on the outside surface of the bra.

In the position of FIG. 1A, the open side seam 20 for insertion of a prosthesis is now positioned on the inside surface of said bra on the left side, serving as a mastectomy bra for patients whose left breast has been surgically removed.

Open side seam 20 serves two essential services in this novel bra concept, a functional need and a mechanical need.

The functional aspect of open side seam 20 is its use to introduce and to remove a prosthesis within the cup and extending rearward along the underarm if needed.

Figure 4:
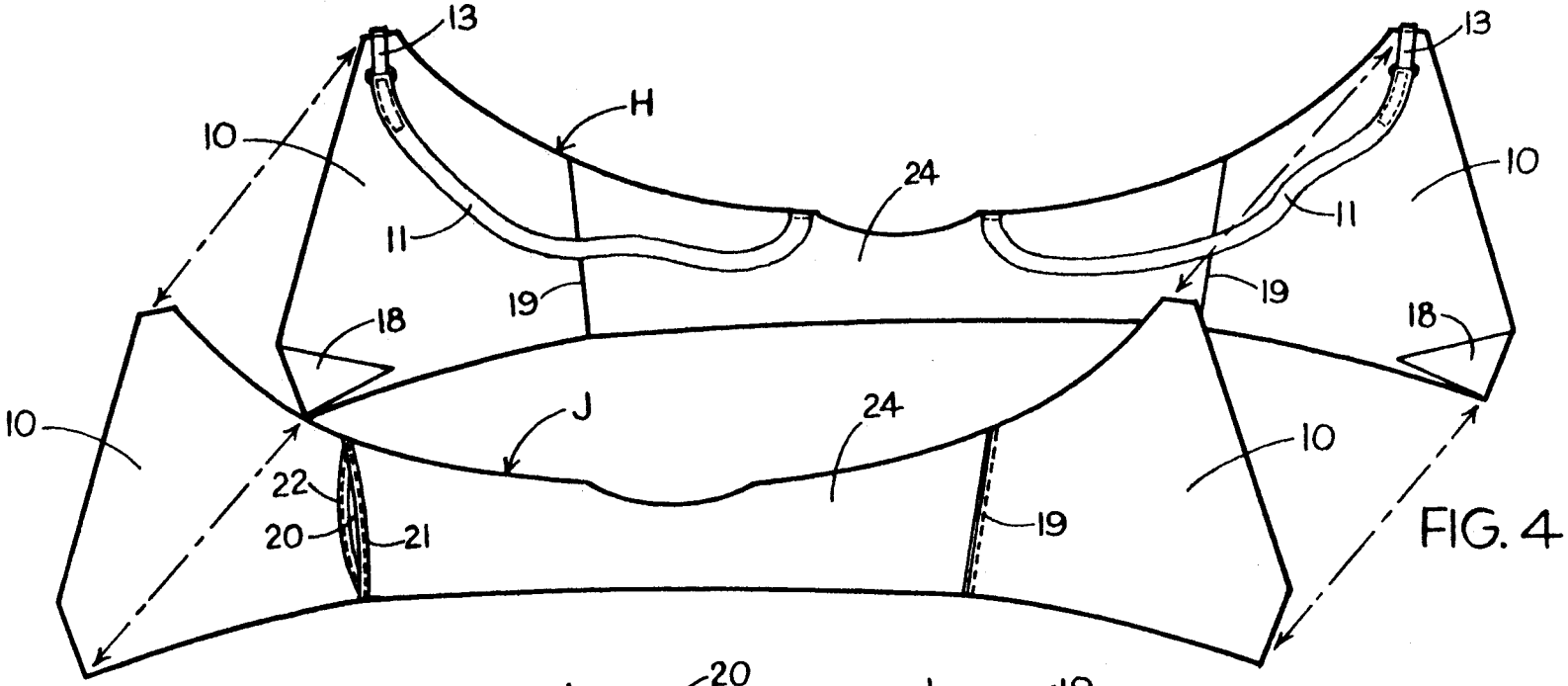
FIG. 4 is a detailed illustration of the two separate bra units and their positioning and method of joining to form one bra.

The mechanical aspect of open side seam 20 is to enable the complete bra to be pulled inside-out upon completion of the assembly of the two separate bra units, as will be shown in detail in FIG. 4.

In FIG. 1, cup 10*a*, back element 15*a*, triangular element 18*a* and open side seam 20 are all located on the patient's right side of the bra, while cup 10*b*, back element 15*b* and triangular element 18*b* are all located on the patient's left side of the bra.

Section A—A of FIG. 1 clearly shows the open seam 20, along with its edges 21 and 22, being located on the front of the bra, while the closed seam 19 appears on the inside surface of the bra. Section B—B shows closed seams 19 on both the front and inside surfaces of the bra on the patient's left side. Triangular element 18*b* with its attached hook 16*b* is shown in attachment with multiple-fold tape 17*b*, while the inside triangular element 18*a* is attached to the inside multiple-fold tape 17*a*.

In FIG. 1, the outside view of strap adjustments 13, and 11*a* and 11*b* are shown. The strap elements 13 are sewn at one end to the upper ends of cups 10*a* and 10*b*, and at the outer ends have a hook attached thereto. Straps 11*a* and 11*b* are attached at one end to back elements 15*a* and 15*b* of back element 24. The other end of straps 11*a* and 11*b* have a strip of multiple-folded tape 14 sewn thereon, with loop 23 attached to the end thereof. Strap 13 is inserted through loop 23 and variably attached to tape 14.

In FIG. 1A, the inside view of strap adjustments 13 and 11*a* and 11*b* are shown, with the tape 14 invisible and loop 23 barely visible.

FIG. 1A being the reverse of FIG. 1, cup 10*b* is therefore located on the patient's right side and cup 10*a* is located on the patient's left side, with accompanying attachments 16, 17 and 18 also being reversed.

As shown in 1A, section A—A shows the outside seam 19 as a closed seam, while seam 20, along with its edges 21 and 22, is shown as an inside open seam. Section B—B shows both inside and outside seams 19 as closed seams.

FIGS. 1 and 1A show a mastectomy bra composed of a minimum of elements or parts, and which is uniquely designed to blend visually with the body contour to give psychological relief to the wearer immediately following her traumatic experience of breast surgery, because the bra configuration and all outer edges have no apparent sewing or standard finish of any kind, whether worn as shown in FIG. 1 or as shown in the reversed position of FIG. 1A.

For purposes of clarity, cups 10*a* and 10*b* in FIGS. 1 and 1A are shown as molded cups, to which a back element 24 is conventially attached, as well as triangular elements 18, which are attached to the center lower front of the cups 10*a* and 10*b*.

Figure 1B:
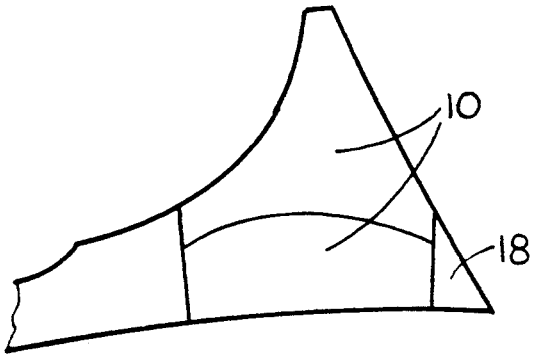
FIG. 1B illustrates an alternative cup construction consisting of two cup elements, an upper element and a lower element.

The cups 10*a* and 10*b* can be designed in a variety of ways in addition to the molded cup design as shown in FIGS. 1 and 1A, such as:

1B-cups having two elements, an upper and a lower element, joined with a center seam as shown in FIG. 1B, the sewing of said two elements being hidden in the same manner as other elements of this bra design.

Figure 1C:
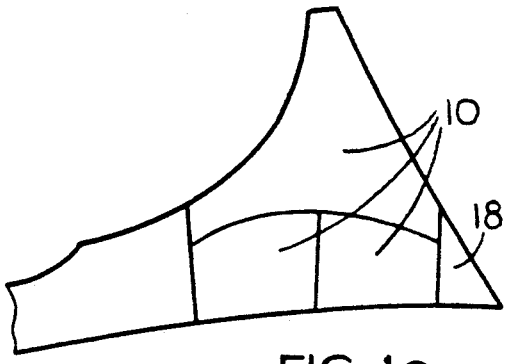
FIG. 1C illustrates an alternative cup construction consisting of three cup elements, one upper element and two lower elements.

1C-Cups having three elements, as shown in FIG. 1C, with seams also hidden.

1D-This mastectomy bra design, as shown clearly in FIGS. 1 and 1A, closes in the front by means of small hooks 16 sewn on both ends of triangular elements 18, sewn to front edges of cups 10, and crossing over each other attach to the connecting multiple-fold tapes 17, located generally off-center at the bottom edges of cups 10.

This unique front closure as shown in 1D allows more coverage on the mastectomy side of the bra by hooking element 16 into the multiple-fold tapes 17 closer to the center front of the bra, thus covering more extensively the chest area. The angle of the front center perimeter of the cup is calculated to cover more of the chest front, starting near the shoulder and crossing over at the bottom edge or perimeter of the bra.

Another very important aspect of this front closure design is that it allows the wearer to tighten the lower portion of the cup to help maintain the position of the bra on the chest and prevent the garment from riding up when using a light-weight prosthesis, without having to resort to weights to anchor the bra.

This novel closure design is also of great value to the mastectomy patient, because when it is worn by the patient to relax or sleep, the adjustable front closing will provide relief from pressure on the chest by loosening the hook and fastening it onto a looser fold of the tape.

These variable adjustments of the front closure can all be done without disturbing the general fit of the cup, because the bra is designed with a rather soft contour in the depth of the cup without defining sharply the apex of the bust. Therefore when observed from the front, the two breasts will appear essentially similar, regardless of the degree and positioning of the closing.

Figure 1D:
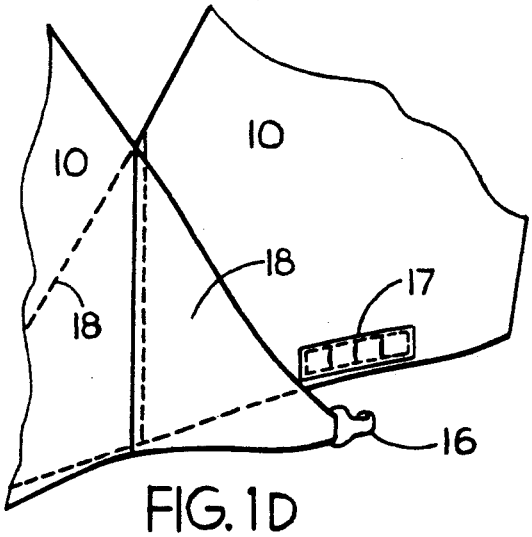
FIG. 1D is a detailed drawing in perspective of the adjustable front closing of the bra.

The use of this preferred embodiment of attaching means for the front closure as illustrated in FIG. 1D does not preclude the use of other means of attachment, such as Velcro, buttons, or other such means well known in the state of the art.

Figure 2A:
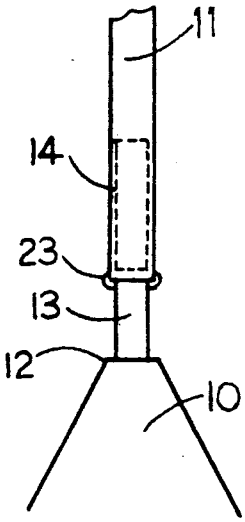
FIG. 2A is a detailed drawing of the right and left side strap adjustments as shown in FIG. 1A.

FIG. 2-The strap and its unique arrangement for length adjustment as shown in FIG. 2 is designed to be as flat and unobtrusive as possible, in such a way as to minimize its appearance when viewed from either side, as in FIG. 2 or FIG. 2A.

Such action in minimizing and disguising the true function of a mastectomy bra is an integral part of the spirit of this invention.

The strap adjustments in FIG. 2 and FIG. 2A are composed of two separate parts, 11 and 13.

Part 13 of the straps is a doubled length of tape with a hook attached to its folded end. The loose end of the tape 13 is passed through a loop 23. The other end of the tape 13 is sewn to the upper end of cup 10 at position 12.

11 is the longer member of the straps, which are composed of the two parts 13 and 11, and has a strip of multiple-fold tape 14 sewn at the front extremity of strap 11, at the end of which is attached loop 23.

This complete strap 11 is sewn at its back extremity 15 to the upper back 24 of the bra, as shown in FIGS. 1 and 1A.

This preferred strap design does not preclude the use of other means of length adjustment, such as snaps, Velcro, buttons, etc.

FIG. 2A shows the reverse side of strap 11 with its adjustments 14 and 23, which would be visible from the reversed side of the bra.

The strap adjustment composed of 13 and 14 of straps 11 will be positioned either outside, away from contact with the body as shown in FIG. 2, or will be positioned against the body as shown in FIG. 2A if the bra is in reversed position.

Figure 3:
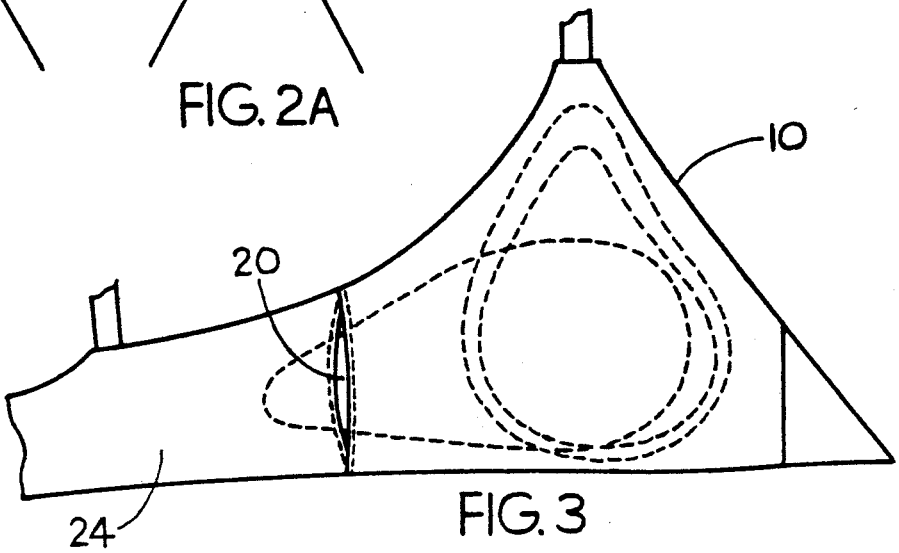
FIG. 3 illustrates the possible variations in positioning variable-shaped prostheses within each cup and back extension.

FIG. 3-The positioning of a prosthesis is one of the problems with all types of breast surgery. The reconstructive surgery may require smaller areas not centered on the breast apex to be filled by the prosthesis, as shown in FIG. 3.

Other types of surgery require single and sometimes multiple prosthesis to fill surgically produced cavities of the chest wall, aside from the breast itself.

As shown in the illustration of FIG. 3, the outer edge configuration of cups 10 of the bra, with its extensive coverage of the breast and chest area, permits the front cup to serve as a total receptacle for the prostheses, whereas in the present state of the art mastectomy bras, with their pocket appendages, restrict the space for the placement of prostheses. In such bras, the side seam usually works as the side limit to the placement of a prosthesis.

This invention does not limit such placement of a prosthesis, as the total cup may be used for placement of a prosthesis in a number of varied positions—vertical, horizontal or lateral. In addition, a prosthesis may be positioned horizontally in such manner as to extend past the open seam 20 rearward into back element 24, to give additional coverage for this area as required, performing its function while being hidden from view inside the bra.

FIG. 4 illustrates the novel concept of this mastectomy bra design, in which two separate bra units of identical shape are combined to form one complete bra sewn around the outer periphery thereof and being open internally throughout the bra area. Such an open but enclosed internal space is the essential element of construction which permits the bra to be turned inside-out through the aforementioned open side seam 20 to create a reversible bra in which no seams are visible whether said bra is worn with one of the two sides visible or reversed so the opposite side is visible when worn.

Bra unit H of FIG. 4 is shown with assembled straps 11 and 13 folded into the unit, along with the two triangular elements 18 folded inward. The two closed seams 19 are shown with no visible sewing, as shown in FIG. 1A.

The second bra unit J of FIG. 4 is shown with closed seam 19 visibly sewn, with the two cloth edges of cup 10 and back element 24 being clearly visible. The two edges 21 and 22 of open seam 20 are also shown with clearly visible sewing.

FIG. 5 shows the two bra units H and J joined together in the manner indicated by arrows in FIG. 4, and bra units H and J are permanently sewn together around their outer periphery as clearly shown by C of FIG. 5.

In FIG. 5, the complete strap units 11 and 13 are now completely enclosed within the two bra units H and J, as well a as triangular elements 18. All sewn seam are now visible on the outer surfaces of both bra unit H and J.

The open internal area formed by units H and J being sewn together around their outer periphery is graphically illustrated by sections E—E, F—F and G—G of FIG. 5

Section F—F is an enlarged view of the sewing construction of open seam 20 on bra unit J and closed seam 19 of bra unit H. Section G—G is an enlarged view of the sewing construction of closed seams 19 of bra units H and J.

In FIG. 6, the two bra units H and J as shown in FIG. 5, being sewn around their outer periphery and being open throughout their internal area, are now in a position to be turned inside-out by pulling the complete sewn bra through the open side seam 20.

FIG. 7 shows the completed mastectomy bra opened out after it has been pulled inside-out through open seam 20 as graphically illustrated in FIG. 6.

Strap units 11 and 13 are now on the outside as well as triangular elements 18 to which hooks 16 have now been sewn in the respective positions as shown. Closed side seams 19 are shown on both the right and left sides of this open bra, while the open side seam 20 is now located on the back of the right side as shown here.

The completed reversible mastectomy bra can now be worn by the patient, attaching it to the breast by connecting hooks 16 to units 17 in a variably adjustable manner, as shown in FIGS. 1 and 1A. A prosthesis of the appropriate shape may now be inserted into bra cup 10 through the open seam 20, for a patient requiring a prosthesis on her right breast, or, by reversing the bra so that the inside of said bra now becomes the outside, said prosthesis would then be positioned on the left breast of the patient.

FIG. 8 is a perspective drawing of the strap adjustments shown in FIG. 2, for further clarification of construction. FIG. 9 is a sectional drawing of the strap adjustments shown in perspective in FIG. 8 for further clarification of construction.

What is claimed is:

1. A reversible mastectomy brassiere to be worn on the left or right breasts of a mastectomy patient composed of two separate but almost identical brassiere forms each form having two cups, said forms are sewn together to form one complete brassiere in such manner as to permit said complete brassiere to be turned inside-out through an open side seam located on one side of one of the two almost identical brassiere forms, resulting therewith in one mastectomy brassiere having a smooth appearance with no visible seams showing, whether said brassiere is worn with one side appearing to view or reversed so another side appearing to view, said open side seam of said reversible brassiere also providing means for the insertion in various positions of a prosthesis which may be positioned on said left breast, or when said brassiere is completely reversed to position said prosthesis on said right breast of said mastectomy patient, adjustable attaching means being provided on bottom front elements of each cup for front closing of said mastectomy brassiere in variable positions.

2. A reversible mastectomy brassiere as in claim 1 in which the two almost identical but separate brassiere forms are brought together and sewn around said two brassiere forms at a periphery thereof to make one complete brassiere.

3. A reversible mastectomy brassiere as in claim 1 in which one of the two separate brassiere forms, which forms are sewn together around a periphery thereof to form one complete brassiere, has included thereon two straps, each one of said straps being attached to a rear element of the brassiere form and to a top apex of each right and left side brassiere cups, said straps being hidden inside the two aforementioned brassiere forms when they are sewn together around their periphery to form one complete brassiere.

4. A reversible mastectomy brassiere as in claim 3 in which each of the aforementioned two straps is composed of two separate elements, one strap element being attached at one end to a rear of the forms of the brassiere and another end consisting of a tape with a step-ladder formation being sewn thereon and which includes a metal loop attached thereto to engage in an adjustable manner a second strap element, one end of which has a hook attached thereon and the other end of which is sewn to the top apex of each cup.

5. A reversible mastectomy brassiere as in claim 1 in which the open side seam located on one side of the two brassiere forms, sewn together to form one complete brassiere, permits access for one of various forms of prostheses to be inserted thereto, said prostheses being positioned in either a vertical, lateral or horizontal position in the brassiere cup as required, including the ability to position said prothesis within the cup area.

6. A reversible mastectomy brassiere as in claim 1 in which the fabric of the two brassiere forms sewn together to form one complete bra is a cotton material.

7. A reversible mastectomy brassiere as in claim 1 in which the construction of the cups of said brassiere may be in the form of two elements joined with a center seam.

8. A reversible mastectomy brassiere as in claim 1 and having a triangular end sewn to each cup and in which the attaching means for front closing of said mastectomy brassiere consists of a small metal hook sewn to said triangular end of each cup; a small strip of multiple-fold tape sewn on each cup inward from said triangular end to accomodate attachment of said hook to said multiple-fold tape in a variety of positions to shorten or lengthen the brassiere to conform to variable chest measurements of mastectomy patients as needed.

9. A reversible mastectomy brassiere as in claim 1 in which two separate brassiere forms of almost identical shape each having an outer periphery are combined to form one complete bra sewn around said outer peripheries thereof, providing an open internal space enclosed by the aforementioned sewing of said outer peripheries, such open internal space being an essential element of construction for the mechanical function of turning the entire brassiere inside-out through an open side seam in one of the two brassiere forms.

10. A reversible mastectomy brassiere as in claim 9 in which the two separate brassiere forms, each having an outer surface, which are sewn together around their outer peripheries to form one complete brassiere, have all their sewn parts visible on a outer surface of each of the two units being thus combined into one, with a result that a function of turning the entire brassiere inside-out through an open side seam in one of the two brassiere forms thus results in all of the sewn parts thereof being almost completely invisible.

* * * * *